US010461476B2

(12) United States Patent
Zhang et al.

(10) Patent No.: US 10,461,476 B2
(45) Date of Patent: Oct. 29, 2019

(54) CONNECTOR

(71) Applicant: Tyco Electronics (Shanghai) Co. Ltd., Shanghai (CN)

(72) Inventors: Jiefeng Zhang, Shanghai (CN); Hao Wang, Shanghai (CN); Biao Pan, Shanghai (CN); Bo Gao, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 12 days.

(21) Appl. No.: 15/795,331

(22) Filed: Oct. 27, 2017

(65) Prior Publication Data

US 2018/0123292 A1 May 3, 2018

(30) Foreign Application Priority Data

Oct. 27, 2016 (CN) ..... 2016 1 0957121

(51) Int. Cl.

| | |
|---|---|
| ***H01R 13/648*** | (2006.01) |
| ***H01R 13/52*** | (2006.01) |
| ***H01R 13/58*** | (2006.01) |
| ***H01R 24/28*** | (2011.01) |
| ***H01R 9/05*** | (2006.01) |
| *H01R 105/00* | (2006.01) |

(52) U.S. Cl.

CPC ..... *H01R 13/648* (2013.01); *H01R 9/0521* (2013.01); *H01R 13/5205* (2013.01); *H01R 13/5825* (2013.01); *H01R 24/28* (2013.01); *H01R 2105/00* (2013.01)

(58) Field of Classification Search

None

See application file for complete search history.

(56) References Cited

U.S. PATENT DOCUMENTS

| | | | | |
|---|---|---|---|---|
| 3,671,922 | A * | 6/1972 | Zerlin | H01R 9/0518 439/352 |
| 4,557,546 | A * | 12/1985 | Dreyer | H01R 9/05 439/320 |
| 4,671,598 | A * | 6/1987 | Keehne | H01R 13/658 439/607.47 |
| 6,439,929 | B1 * | 8/2002 | Jenets | H01R 9/032 439/276 |
| 8,465,322 | B2 * | 6/2013 | Purdy | H01R 9/0524 439/584 |
| 9,190,744 | B2 * | 11/2015 | Burris | H01R 13/6581 |
| 9,240,636 | B2 * | 1/2016 | Youtsey | H01R 13/622 |

* cited by examiner

*Primary Examiner* — Xuong M Chung Trans

(74) *Attorney, Agent, or Firm* — Barley Snyder

(57) ABSTRACT

A connector comprises a housing, a connector body disposed in the housing, a conductive terminal disposed in the connector body, and a conductive shielding sleeve. The conductive shielding sleeve is disposed in the housing such that at least a part of an outer end of the conductive shielding sleeve extends to an exterior of the housing when the conductive shielding sleeve is fully mounted in the housing.

24 Claims, 5 Drawing Sheets

CONNECTOR

CROSS-REFERENCE TO RELATED APPLICATION

This application claims the benefit of the filing date under 35 U.S.C. § 119(a)-(d) of Chinese Patent Application No. 201610957121.4, filed on Oct. 27, 2016.

FIELD OF THE INVENTION

The present invention relates to a connector and, more particularly, to a connector having a conductive shielding sleeve.

BACKGROUND

In the prior art, a cylindrical electrical connector generally includes an insulation body, a conductive terminal held in the insulation body, a metal housing fitted over and mounted to the insulation body, and a conductive shielding sleeve mounted in one end of the metal housing. A wire may be inserted into the connector from one end of the metal housing and electrically connected to the conductive terminal in the connector. The conductive shielding sleeve is fitted over a conductive shielding layer of the wire, providing electromagnetic shielding for the wire to ensure signal transmission quality.

The conductive shielding sleeve is commonly housed in one end of the metal housing. A finger of a user cannot directly contact the conductive shielding sleeve from the outside of the metal housing, making it difficult to manually remove the conductive shielding sleeve from the metal housing and making disassembly of the connector difficult. A sealing sleeve fitted over an outer cladding layer of the wire is commonly located outside the conductive shielding sleeve. The sealing sleeve cannot be positioned adjacent the conductive shielding sleeve, resulting in deformation and deterioration of the sealing sleeve.

SUMMARY

A connector according to the invention comprises a housing, a connector body disposed in the housing, a conductive terminal disposed in the connector body, and a conductive shielding sleeve. The conductive shielding sleeve is disposed in the housing such that at least a part of an outer end of the conductive shielding sleeve extends to an exterior of the housing when the conductive shielding sleeve is fully mounted in the housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
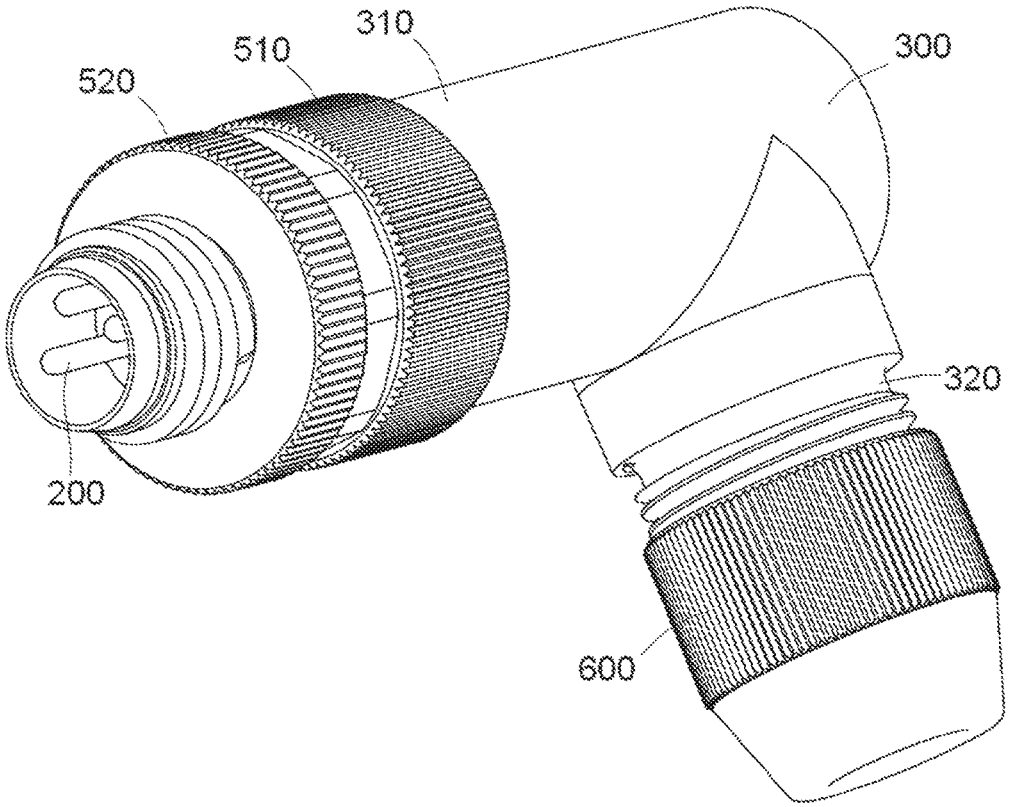
FIG. 1 is a perspective view of a connector according to an embodiment of the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
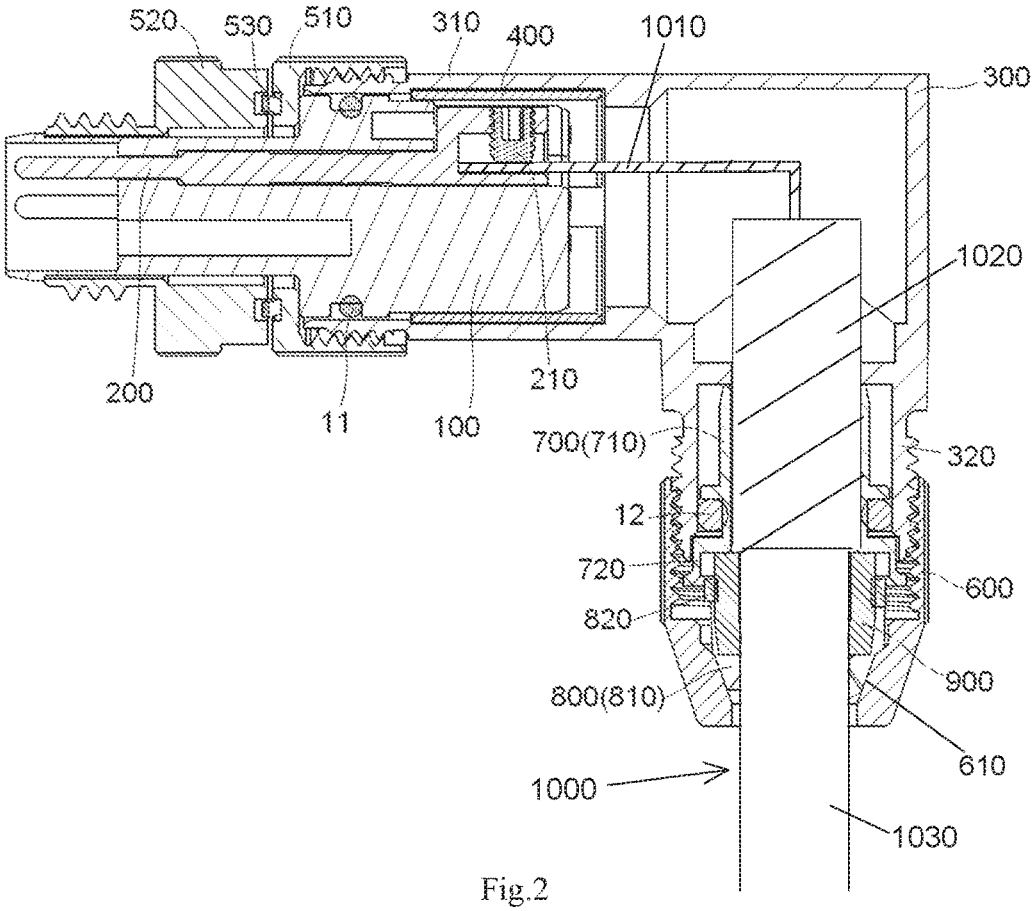
FIG. 2 is a sectional side view of the connector of FIG. 1.
Figure 5:
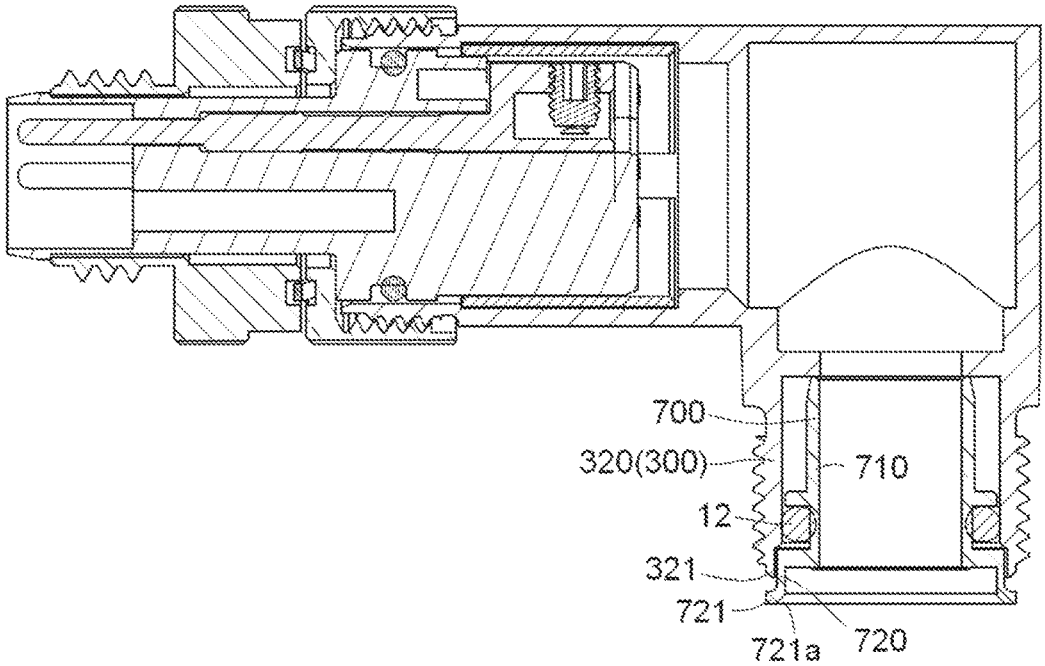
FIG. 5 is sectional side view of the connector of FIG. 1.

A connector according to an embodiment of the invention is shown in FIGS. 1, 2, and 5. The connector comprises a connector body 100, a conductive terminal 200, a housing 300, and a conductive shielding sleeve 700. In the shown embodiment, the connector is formed as a circular connector having a circular cross-section.

The connector body 100, as shown in FIGS. 1 and 2, is received in the housing 300. The conductive terminal 200 is held in the connector body 100 and adapted or configured to be electrically connected to a conductor 1010 of a wire 1000 inserted into the housing 300. In an embodiment, the connector body 100 is formed of an insulative material, such as a plastic. In an embodiment, the housing 300 is formed of a conductive material, such as a metal.

The conductive shielding sleeve 700, as shown in FIGS. 1, 2, and 5, is mounted in the housing 300 and adapted or configured to be fitted over a conductive shielding layer 1020 of the wire 1000. As shown in FIG. 5, when the conductive shielding sleeve 700 is fully mounted in the housing 300, at least a part of an outer end 720 of the conductive shielding sleeve 700 extends to an exterior of the housing 300. An operator may directly hold the outer end 720 of the conductive shielding sleeve 700 by hand, such that the conductive shielding sleeve 700 may be easily manually removed from the housing 300, improving the efficiency and convenience of disassembly of the connector.

Figure 3:
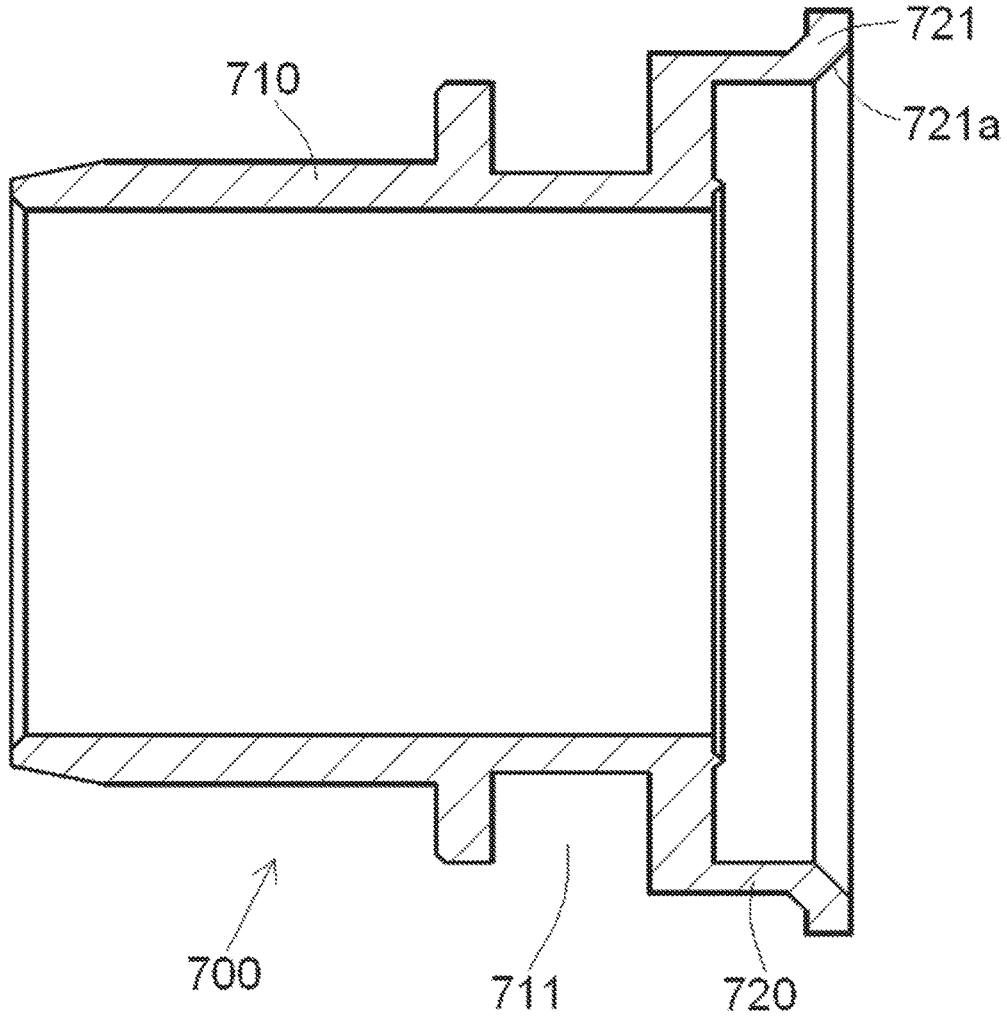
FIG. 3 is a sectional side view of a conductive shielding sleeve of the connector of FIG. 1.
Figure 4:
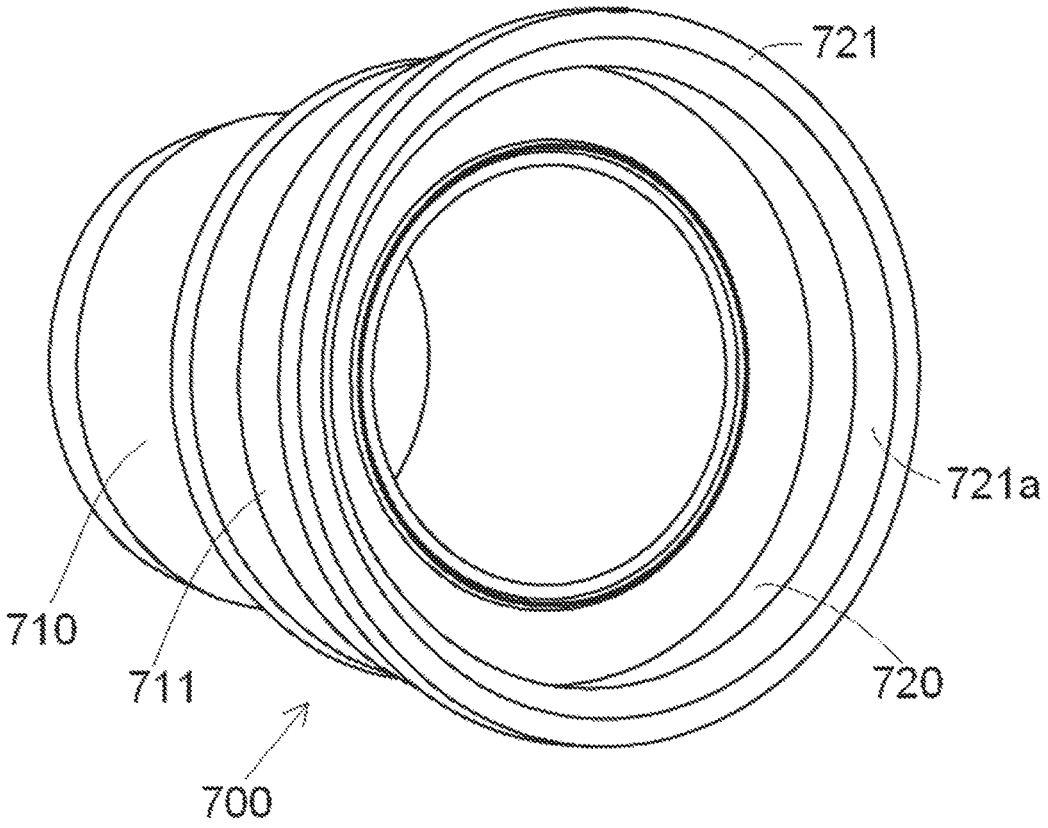
FIG. 4 is a perspective view of the conductive shielding sleeve of FIG. 3.

The conductive shielding sleeve 700 is shown in detail in FIGS. 3 and 4. The outer end 720 of the conductive shielding sleeve 700 has an outwardly turning or extending lip 721. An inner diameter of the outer end 720 is greater than an inner diameter of a sleeve body 710 of the conductive shielding sleeve 700. A circular groove 711 is formed in the sleeve body 710 of the conductive shielding sleeve 700. The lip 721 is located outside the housing 300 and is spaced apart from the housing 300 by a predetermined distance as shown in FIG. 5. The lip 721 has a tapered opening 721*a* which gradually contracts inwardly.

As shown in FIG. 2, the connector further comprises a sealing sleeve 900 adapted to be fitted over an outer cladding layer 1030 of the wire 1000, a clamping ring 800 fitted over and mounted to the sealing sleeve 900, and a threaded sleeve 600 connected to the housing 300.

The threaded sleeve 600 presses the clamping ring 800 to hold the sealing sleeve 900 against the wire 1000 through the clamping ring 800. The sealing sleeve 900 and the clamping ring 800 fitted over the sealing sleeve 900 are adapted to be partially received and positioned in the outer end 720 of the conductive shielding sleeve 700, as shown in FIG. 2, ensuring that the sealing sleeve 900 and the clamping ring 800 are installed in proper positions and improving a sealing effect of the sealing sleeve 900. The tapered opening 721*a* of the lip 721 guides the sealing sleeve 900 and the clamping ring 800 into the outer end 720 of the conductive shielding sleeve 700.

The clamp ring 800, as shown in FIG. 2, comprises a cylindrical body 820 and a plurality of resilient latches 810 connected to the cylindrical body 820, the plurality of resilient latches 810 being circumferentially spaced apart around the cylindrical body 820. The threaded sleeve 600 comprises a tapered inner wall surface 610 which gradually contracts outwardly and is configured to press the plurality of resilient latches 810 of the clamping ring 800 against the sealing sleeve 900.

The housing 300, as shown in FIG. 2, comprises a first end 310 and a second end 320. The first end 310 of the housing 300 is perpendicular to the second end 320 such that the connector is formed as a right-angled elbow connector. The connector body 100 is received in the first end 310 of the housing 300 and the wire 1000 extends from the second end 320 of the housing 300 into the connector. The conductive shielding sleeve 700 is mounted in the second end 320 of the housing 300 and the threaded sleeve 600 is threadedly connected to the second end 320. The lip 721 is spaced apart from an end face 321 of the second end 320 of the housing 300 by a predetermined distance. A finger of a user may extend into the gap between the lip 721 and the end face 321 of the second end 320 of the housing 300, as shown in FIG. 5, facilitating manual grasping and pulling out of the conductive shielding sleeve 700. The sleeve body 710 of the conductive shielding sleeve 700 is completely received in the second end 320 of the housing 300.

A first sealing ring 12 is disposed between the sleeve body 710 and the housing 300 as shown in FIG. 2. The first sealing ring 12 is positioned in the circular groove 711 of the conductive shielding sleeve 700 and compressed between the conductive shielding sleeve 700 and the housing 300.

The connector further comprises an isolating sleeve 400 disposed between the connector body 100 and the housing 300 to electrically isolate the housing 300 from the conductive terminal 200.

As shown in FIG. 2, a circular groove is formed in the outer wall of the connector body 100 and receives a second sealing ring 11 therein. The second sealing ring 11 is compressed between the connector body 100 and the housing 300.

The connector, as shown in FIG. 2 further comprises a screw 210 adapted to be threadedly connected to one end of the conductive terminal 200 and to press and fix one end of the conductor 1010 extending into the connector onto one end of the conductive terminal 200, so as to electrically connect the wire 1000 to the conductive terminal 200. The connector further comprises a first nut 510 threadedly connected to the first end 310 of the housing 300, the first nut 510 being adapted to position the connector body 100 in the housing 300. One end of the connector body 100 extends outwardly from the first end 310 of the housing 300, and the connector further comprises a second nut 520 fitted over and mounted on the one end of the connector body 100 extending outwardly from the first end 310 of the housing 300, the second nut 520 being adapted to be threadedly connected to a mating connector. A resilient conductive element 530 is provided between the first nut 510 and the second nut 520 and compressed therebetween such that the first nut 510 and the second nut 520 are electrically connected to each other.

What is claimed is:

1. A connector, comprising:

a housing;

a connector body disposed in the housing;

a conductive terminal disposed in the connector body; and a conductive shielding sleeve disposed in the housing such that at least a part of an outer end of the conductive shielding sleeve extends to an exterior of the housing when the conductive shielding sleeve is fully mounted in the housing, the outer end of the conductive shielding sleeve has an outwardly turning lip disposed outside the housing and spaced apart from the housing by a predetermined distance.

2. The connector of claim 1, wherein the housing is formed of a metal material and the connector body is formed of an insulative material.

3. The connector of claim 1, wherein the conductive terminal is electrically connected to a wire inserted into the housing and the conductive shielding sleeve is fitted over a conductive shielding layer of the wire.

4. The connector of claim 3, further comprising a sealing sleeve fitted over an outer cladding layer of the wire, a clamping ring fitted over and mounted on the sealing sleeve, and a threaded sleeve threadedly connected to the housing.

5. The connector of claim 4, wherein the threaded sleeve presses the clamping ring to hold the sealing sleeve against the wire through the clamping ring.

6. The connector of claim 5, wherein the sealing sleeve and the clamping ring are partially received and positioned in the outer end of the conductive shielding sleeve.

7. The connector of claim 6, wherein the lip has a tapered opening which gradually contracts inwardly and guides the sealing sleeve and clamping ring into the outer end of the conductive shielding sleeve.

8. The connector of claim 7, wherein the clamping ring has a cylindrical body and a plurality of resilient latches connected to the cylindrical body, the resilient latches circumferentially spaced apart around the cylindrical body.

9. The connector of claim 8, wherein the threaded sleeve has a tapered inner wall surface which gradually contracts outwardly and presses the resilient latches of the clamping ring against the sealing sleeve.

10. The connector of claim 4, wherein the housing has a first end and an opposite second end, the conductive shielding sleeve mounted in the second end of the housing and the threaded sleeve threadedly connected to the second end of the housing.

11. The connector of claim 10, wherein the lip of the conductive shielding sleeve is spaced apart from an end face of the second end of the housing by the predetermined distance.

12. The connector of claim 1, wherein an inner diameter of the outer end of the conductive shielding sleeve is greater than an inner diameter of a sleeve body of the conductive shielding sleeve.

13. The connector of claim 12, further comprising a first sealing ring disposed and compressed between the sleeve body and the housing.

14. The connector of claim 13, wherein the first sealing ring is positioned in a circular groove of the sleeve body.

15. The connector of claim 1, further comprising an isolating sleeve disposed between the connector body and the housing and electrically isolating the housing from the conductive terminal.

16. The connector of claim 3, wherein the housing has a first end and an opposite second end extending perpendicular to the first end.

17. The connector of claim 16, wherein the connector body is disposed in the first end of the housing and the wire extends into the connector from the second end of the housing.

18. The connector of claim 17, further comprising a first nut threadedly connected to the first end of the housing and positioning the connector body in the housing.

19. The connector of claim 18, wherein an end of the connector body extends outwardly from the first end of the metal housing.

20. The connector of claim 19, further comprising a second nut fitted over and mounted on the end of the connector body extending outwardly from the first end of the housing, the second nut threadedly connected to a mating connector.

21. The connector of claim 20, further comprising a resilient conductive element disposed and compressed between the first nut and the second nut and electrically connecting the first nut and the second nut.

22. The connector of claim 1, wherein the connector has a circular cross-section.

23. The connector of claim 3, further comprising a screw threadedly connected to an end of the conductive terminal and fixing a conductor of the wire to the conductive terminal to electrically connect the wire and the conductive terminal.

24. A connector, comprising:

a housing having a first end and an opposite second end extending perpendicular to the first end;

a connector body disposed in the first end of the housing, an end of the connector body extends outwardly from the first end of the housing;

a conductive terminal disposed in the connector body and electrically connected to a wire inserted into the housing, the wire extends into the second end of the housing;

a conductive shielding sleeve disposed in the housing such that at least a part of an outer end of the conductive shielding sleeve extends to an exterior of the housing when the conductive shielding sleeve is fully mounted in the housing, the conductive shielding sleeve is fitted over a conductive shielding layer of the wire;

a first nut threadedly connected to the first end of the housing and positioning the connector body in the housing;

a second nut fitted over and mounted on the end of the connector body extending outwardly from the first end of the housing, the second nut threadedly connected to a mating connector; and a resilient conductive element disposed and compressed between the first nut and the second nut and electrically connecting the first nut and the second nut.

* * * * *